US006119288A

United States Patent [19]

Hendrickson

[11] Patent Number: 6,119,288

[45] Date of Patent: Sep. 19, 2000

[54] PLAY PEN

[76] Inventor: Philip J. Hendrickson, 2896 Newton Ave., San Diego, Calif. 92113

[21] Appl. No.: 09/362,074

[22] Filed: Jul. 27, 1999

[51] Int. Cl.[7] ..... A47D 13/06

[52] U.S. Cl. ..... 5/97; 5/98.1; 5/99.1

[58] Field of Search ..... 5/93.1, 97, 98.1, 5/99.1, 945

[56] References Cited

U.S. PATENT DOCUMENTS

| | | | |
|---|---|---|---|
| 2,308,608 | 1/1943 | Kennedy | 5/99.1 |
| 3,619,825 | 11/1971 | Taub et al. | 5/97 X |
| 3,763,506 | 10/1973 | Szego | 5/99.1 X |
| 4,003,098 | 1/1977 | Fink | 5/945 X |
| 4,008,499 | 2/1977 | Wren, Jr. et al. | 5/99 |
| 4,073,017 | 2/1978 | Stevens | 5/97 |
| 4,583,253 | 4/1986 | Hall | 5/94 |
| 4,670,923 | 6/1987 | Gabriel et al. | 5/424 |
| 4,815,153 | 3/1989 | Blesser et al. | 5/98.1 |
| 4,819,284 | 4/1989 | Brown | 5/98.1 |
| 4,827,542 | 5/1989 | Kurtenbach et al. | 5/93 |
| 4,945,584 | 8/1990 | LaMantia | 5/97 |
| 5,291,623 | 3/1994 | Artz | 5/99.1 |

FOREIGN PATENT DOCUMENTS

| | | | |
|---|---|---|---|
| 0156089 | 4/1954 | Australia | 5/98.1 |

*Primary Examiner*—Michael F. Trettel
*Attorney, Agent, or Firm*—Frank G. Morkunas

[57] ABSTRACT

A play pen with an inflatable base having a bottom and at least three outer edges; inflatable side walls equal in number to the number of outer edges on the base, with a first side wall connected to one outer edge of the base, and the first two remaining side walls attached to each side of the first side wall, and all the side walls being removably attachable at their bottoms to a corresponding outer edge of the base, leaving two side walls as distal end side walls each being removably attachable to the other; base supports and side supports to provide structural integrity to the play pen; and a removable canopy on top of the play pen held by canopy connectors on the side supports.

33 Claims, 3 Drawing Sheets

PLAY PEN

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improvement in play pens, and more particularly to a collapsible, inflatable, portable play pen which is light weight, easy to store, easy to use, easy to set up, easy to dismantle, and safe and enjoyable to use.

Play pens have been in existence for many years. Over time they have become more portable and easy to use. Traditionally, play pens were constructed of wood and later of plastics. As our society became more mobile, a need arose for more portable, light weight, and easy-to-use play pens. Use of cushions and mesh screening, as well as inflatable materials, have become popular for play pens and similar objects. Reference is made to the Wren patent, U.S. Pat. No. 4,008,499, issued on Feb. 22, 1977; the Hall patent; U.S. Pat. No. 4,583,253, issued on Apr. 22, 1986; the Gabriel patent, U.S. Pat. No. 4,670,923, issued on Jun. 9, 1987; and the Kurtenbach patent, U.S. Pat. No. 4,827,542, issued on May 9, 1989. Each of these inventions utilize concepts of portability, inflatability, collapsibility, and ease of use; and though each is suited for the intended purpose, none incorporates all the unique and novel features associated with the present invention.

The present invention is a self-sufficient portable play pen which enjoys all the structural elements of a regular play pen and more. As part of its structural elements, the present invention has a cushion or mattress as part of its base, it has at least one side wall permanently connected to the base, and other side walls, in such a fashion that, when the play pen is erected for use, all the side walls easily and securingly fit into place. The side walls further have screen-like and window-like structures therein to permit viewing into and out of the play pen. A removable cover or canopy, also having screen-like structures, further protects a child with from the elements and insects of nature while facilitating the flow of fresh air throughout the play pen.

Moreover, the base and side walls of the play pen are more easily collapsible and more easily erectable, because of their inflatability features and foldability features. Inflating provides the support and cushion protection necessary for the proper care of a young child. Base support and side support members easily attach to, and from, the play pen thereby providing more firm support than similar inflatable objects. The unique and novel features of the present invention combine in such a manner never thought of before and in such a way as to provide a superior quality and a safer play pen for children.

Accordingly, several objects and advantages of my invention are to:

a. provide a play pen for our mobile society which is light weight and easy to assemble and disassemble;

b. provide a safer and more comfortable play pen for use;

c. create a play pen which protects from environmental hazards and/or nuisances while still providing an avenue for a child therein to receive and enjoy fresh outdoor air;

d. provide a play pen which easily inflates each section of the play pen either individually or through one common means;

e. make a collapsible play pen which has firm foundational supports; and f. provide a play pen which is economical and long lasting.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a play pen with an inflatable base having a bottom and at least three outer edges; and inflatable side walls equal in number to the number of outer edges on the base, with a first side wall connected to one outer edge of the base, and the first two remaining side walls attached to each side of the first side wall, and all the side walls being removably attachable at their bottoms to a corresponding outer edge of the base, leaving two side walls as distal end side walls each being removably attachable to the other. Base supports and side supports provide structural integrity to the play pen. A removable canopy rests atop the play pen held securingly in place by canopy connectors located on the side supports.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
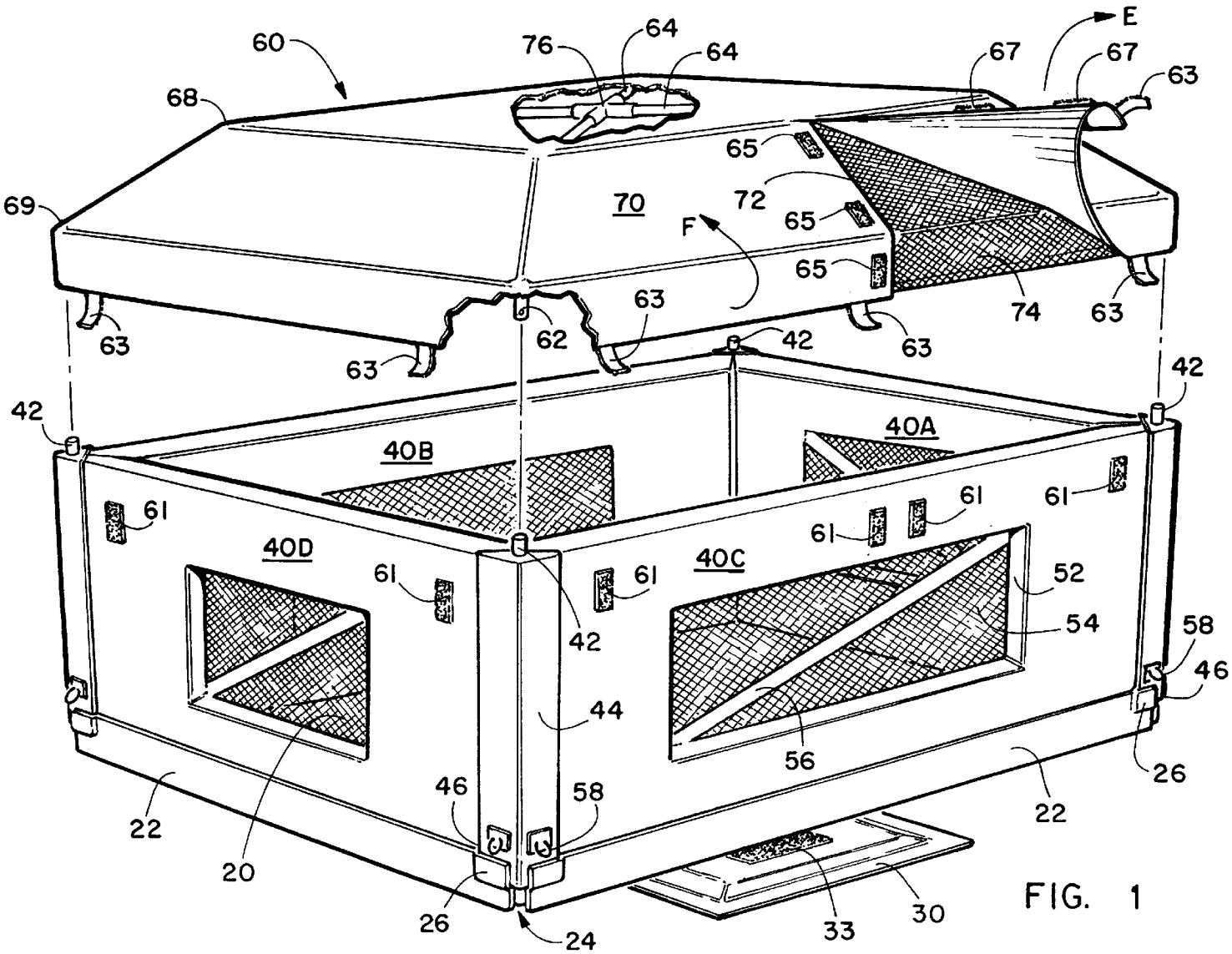
FIG. 1 is perspective, partially exploded, view of the play pen.
Figure 2:
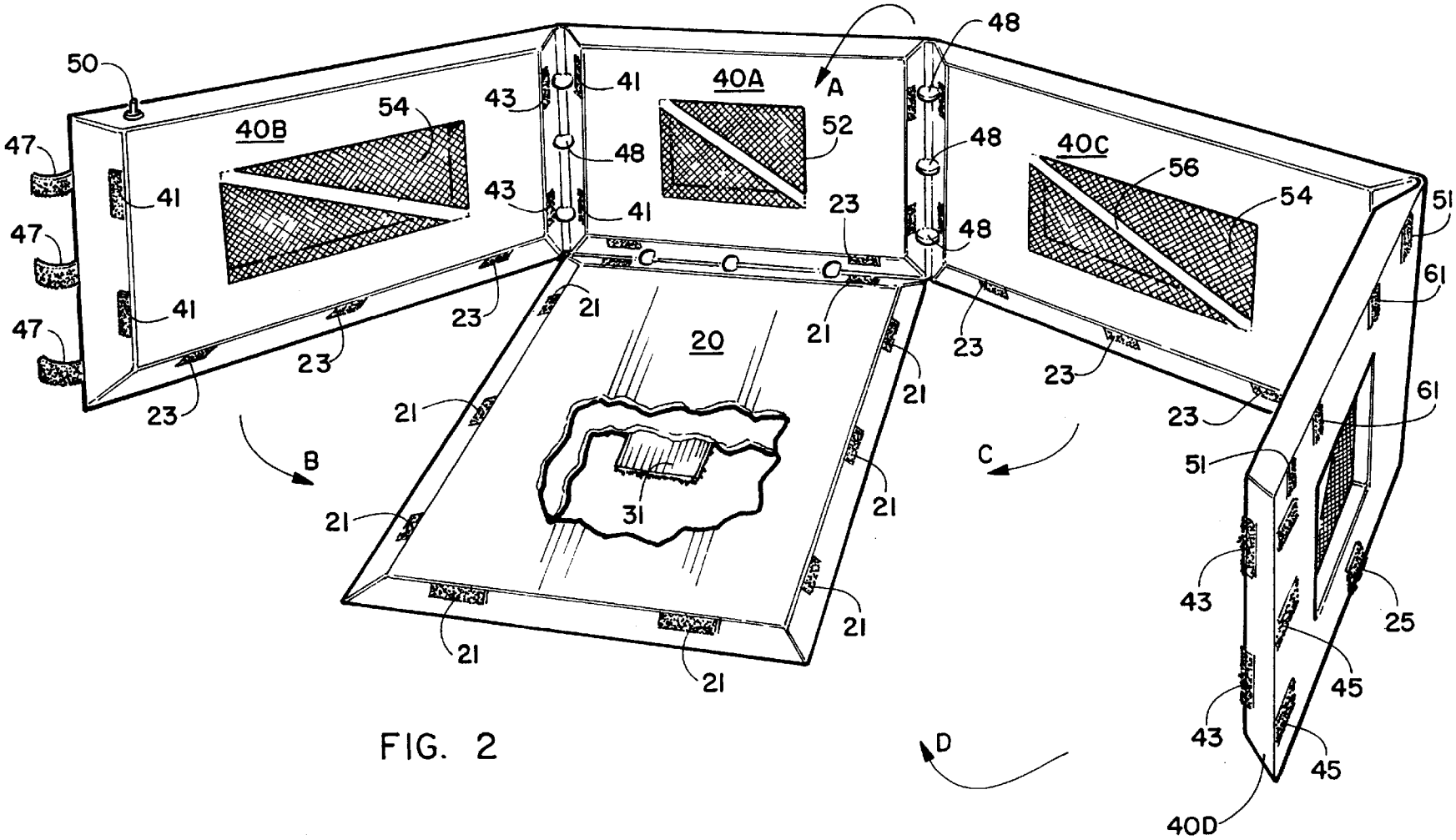
FIG. 2 is a detailed view of the base and side walls of the play pen.

Reference is now made to the drawings in detail, and in particular to FIG. 1, which is an illustration of the play pen constructed in accordance with a preferred embodiment of the present invention. FIG. 2 illustrates in detail the structure of the base 20 in relation to the side walls 40A–D. As shown here, one side wall 40A is permanently connected to the base 20 at one of its outer edges and is movable such that side wall 40A can be folded over or under the base 20. A second side wall 40B and a third side wall 40C are movably and foldably attached to opposite side of the first side wall 40A. In this configuration of my play pen, a fourth side wall 40D is movably and foldably attached to the third side wall 40C. It may just as easily be constructed to be movably and foldably attached to the second side wall 40B.

The configuration of this play pen bears four side walls and a base (five sections), though it may be structured to have three side walls and a base (four sections) or five or more side walls and a base. Each side wall 40A–D has a bottom surface, a top surface, and two side surfaces. Regardless of how many outer edges are on the perimeter of the base 20, there should be an equal number of movable and foldable side walls 40. For circular or curvilinear bases 20, only one side wall is necessary. The preferred embodiment of my invention envisions each section to be constructed of an inflatable type material such as, but not limited to, a polymer, vinyl, or rubber having and inflatable exterior walls or a skin and a cavity within to receive and hold air entering this cavity. It also may be constructed of any collapsible material, such as, but not limited to, polymers, vinyl, or rubber without a cavity within and, therefore, not inflatable.

Air ducts or channels 48 are located between the first side wall 40A and the base 20 and are also located between the adjacent side surfaces of the remaining side walls. An air valve 50 is shown in FIG. 2 to be on the second side wall 40B though it may be placed on any side wall or the base 20. In this embodiment, as the play pen is inflated from an external source, air passes into the second side wall 40B and, through the air ducts 48 between the side walls and the air ducts 48 between the first side wall 40A and the base 20, air passes into each section (other side walls and the base 20). The play pen is thereby inflated until each section is rather firm.

As so configured, after the play pen has been used and is dismantled, it will fold easily and will fold flat. Very little storage space will be needed to store or transport the play pen thereby making it more versatile, and easy to use, than any other play pen currently in existence.

After the play pen is inflated, the first side wall 40A is moved in the direction of arrow A approximately 90°. This brings up the other side walls. In this upstanding position, the second wall 40B is moved in the direction of arrow B, also approximately 90°, followed by the third side wall 40C and the fourth side wall 40D in the direction of arrow C and D, respectively, each approximately 90°. The perimeter (outer edges) of the base 20 and the bottom surfaces and the side surfaces of each side wall 40A–D may be beveled such that, when each section is inflated, the side walls 40A–D are placed in an upstanding position and configured around the base 20, relatively tight corners are enjoyed. For good results, I have found that the beveled angle should be between about 30–60°, with an angle of between about 40–50° being better.

To aid in holding the side walls 40A–D in an upstanding position, suitable connectors 21 are placed on the beveled perimeter of the base 20 with corresponding connectors 23 on the bottom surfaces of each side wall 40A–D. Any connector suited for the intended purpose may be used including, but not limited to hook-and-loop (i.e., Velcro-type), restickable adhesive or adhesive tape, magnetic strips, and the like. Additional connectors 41, 43 on the side surfaces of each side wall 40A–D further aid in holding the side walls 40A–D more firmly in place. Similarly, any connector suited for the intended purpose may be used including, but not limited to hook-and-loop (i.e., Velcro-type), restickable adhesive or adhesive tape, magnetic strips, and the like. After the side walls 40A–D have been attached to the base 20 and to each other through the folds explained above, a final attachment is made between the second side wall 40B and the fourth side wall 40D by means of connectors 45, 47. As before, any connector suited for the intended purpose may be used including, but not limited to hook-and-loop (i.e., Velcro-type), restickable adhesive or adhesive tape, magnetic strips, and the like.

Figure 3:
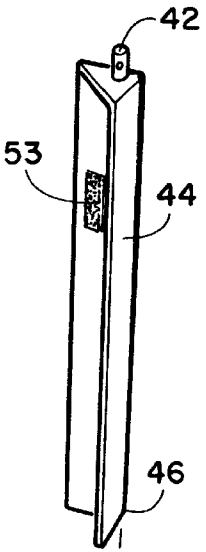
FIG. 3 is a detailed view of the base support and side support structures.
Figure 3:
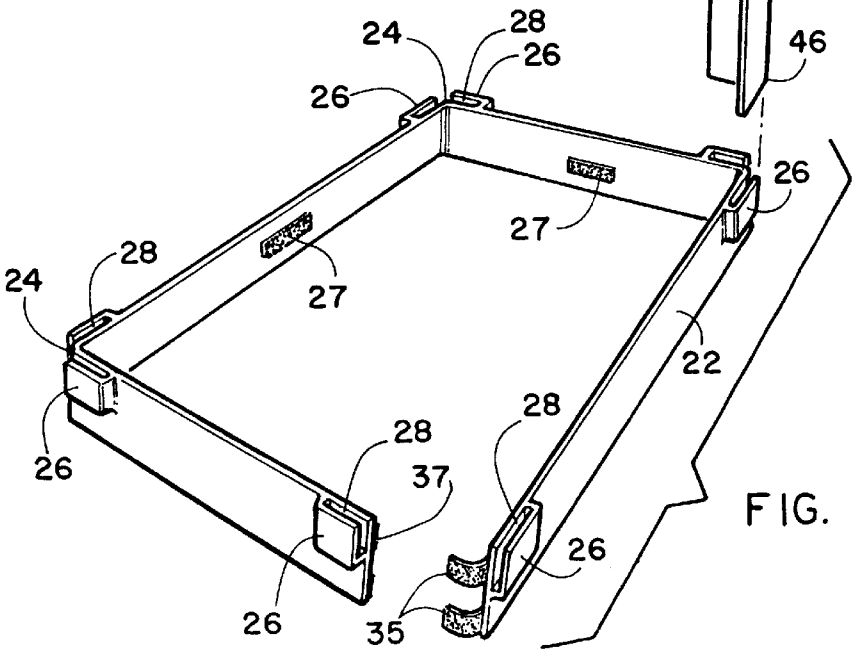

Greater support for the play pen is ensured by use of a base support 22 and side support 44. In this rectilinear embodiment of the play pen, there are four base supports 22 and four side supports 44 (for a tri-angularly shaped play pen, the base would have three outer edges and three side walls whereas a curvilinear base would have a single ring-like outer edge [with no defined corners] and one correspondingly shaped side wall). Each side support 44 also has a bottom 46 and a canopy connector 42 at its top (the purpose of this canopy connector to be explained later). Reference now should be made to FIGS. 1, 2, and 3. Each base support unit 24 has a slot 26 on each end and a connector 27 in the inside of the base support unit 22. This connector 27 of the base support unit 22 removably attaches to a corresponding connector 25 located on each side wall 40A–D adjacent to the bottom of each side wall 40A–D. After each base support unit 22 is so attached to the side walls 40A–D, the adjacent end units may be connected to one another by connectors 35, 37 located at their adjacent respective ends. Any connector suited for the intended purpose may be used including, but not limited to hook-and-loop (i.e., Velcro-type), restickable adhesive or adhesive tape, magnetic strips, and the like. Once the base supports 22 are so connected around the base 20, a corner 24 and a receptacle 28 are formed thereat from the slots 26 into which the bottoms 46 of the side supports 44 may be inserted and held in place. To further aid in holding the side supports 44 onto the play pen, connectors 51 on the upper portion of the side walls correspond to connectors 53 on the inside and upper portion of each side support 44. Any connector suited for the intended purpose may be used including, but not limited to hook-and-loop (i.e., Velcro-type), restickable adhesive or adhesive tape, magnetic strips, and the like.

This play pen, as so constructed and formed, provides a soft interior for a child and safety barriers (the side walls) to prevent a child inside from roaming out and exploring and encountering any attendant potential dangers. To provide a view to the outside for a child within, one or more side walls may be constructed to have one or more openings or windows 52. The windows may be made of a rigid polymer or glass-like material, may be made of a resilient flexible material such as various polymers or vinyl, may be transparent or translucent, may be made of a mesh-like or screening material, may be made of an air-resistant or water-resistant material, or may be removable or permanently affixed to the side walls, or any combinations thereof.

For ease of manufacture and ease of use by an end-user, I have found that having this opening 52 divided by a diagonal divider 56 is preferred. A mesh-like structure (or screen) 54 covers the entire opening 52 and a transparent air-resistant resilient material (window) may cover the screen 54. It is best that this window be removable such that, when removed, ambient air may more freely circulate within the play pen.

Figure 4:
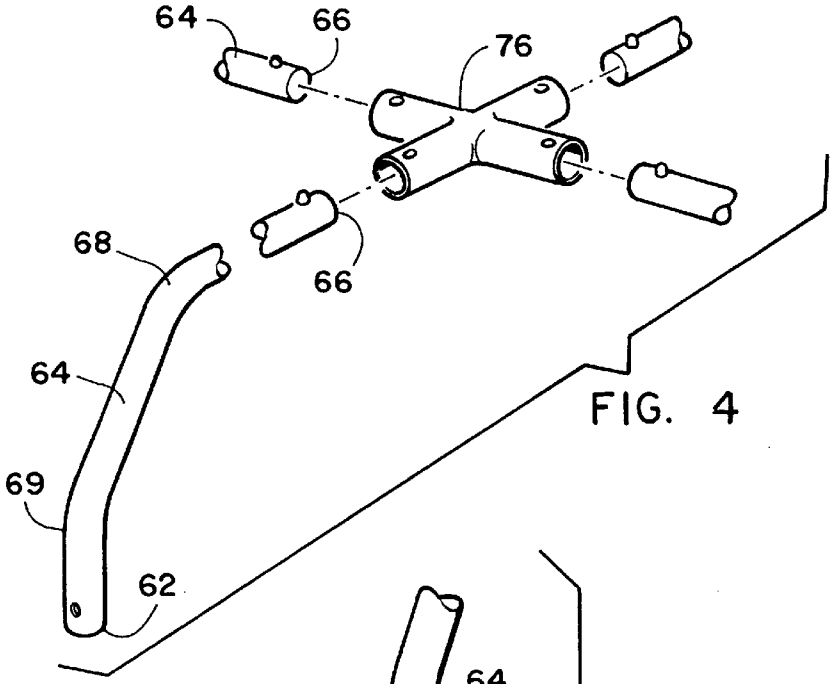
FIG. 4 is a detailed, partial, view of the canopy support frame.
Figure 5:
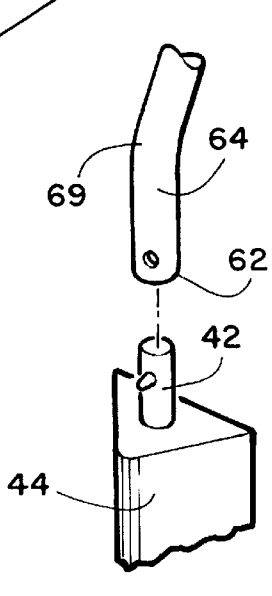
FIG. 5 is a detailed, partial, view of the canopy support frame arm and the side support member.

For outdoor use, and for greater protection for the child, a removable canopy structure 60 covers the play pen. Reference now is made to FIGS. 1, 4, and 5. This canopy structure 60 has an internal frame support comprised of a frame connector 76 into which frame arms 64 are connected at one end 66. The other end, the distal end 62, of the frame arms 64 are connected to the canopy connector 42 on each side support 44. The frame arms 64 are connected to, and remain held at, the frame connector 76 and the respective canopy connectors 42 by friction fit, by a detent and respective aperture, by a spring-button and corresponding aperture, and the like. The frame arms 64 have a first bend 68 and a second bend 69. A cover 70 fits over the frame as so formed. The bottom-most portion of the cover 70 extends downward below the distal end 62 of the frame arms 64. Therefore, when the canopy structure 60 is placed onto the play pen by inserting the distal ends 62 of each frame arm 64 into the respective canopy connectors 42 located on each side support 44, the canopy structure 60 is firmly in place and the bottom-most portion of the cover 70 covers the upper-most portion of each side support 44. Additional connectors 63 on the cover 70, adjacent to the bottom of the cover 70, connect to corresponding connectors 61, near to the top portions of each side wall 40A–D, to provide further retaining support for the canopy structure 60 as it is seated atop the play pen.

So a child may enjoy the quality of outdoor life when inside this play pen with its canopy structure 60 seated on top, the cover 70 has a slit 72 on one or more sides running from the bottom of the cover up to the second bend 69 or up to the first bend 68. This permits the cover 70 to be peeled or unfolded as flaps in the direction of arrows E and F to thereby create an opening or viewing area from the top of the play pen. The flaps are held closed when not needed by connectors 65, 67 adjacent to the slit 72. Any connector suited for the intended purpose may be used including, but not limited to hook-and-loop (i.e., Velcro-type), restickable adhesive or adhesive tape, magnetic strips, and the like. A mesh-like or screen layer 74 underlies this opening to keep unwanted living elements of nature from entering the living space of a child inside while still permitting for the healthy circulation and entrance of ambient air. This screen 74 also may have a slit (not shown) and connectors (not shown), similar in nature to the slit 72 and its connectors 65, 67 of the cover. This permits a user of the play pen to completely expose the interior of the play pen, while maintaining the canopy structure 60 in place, in order to better view the child within or to remove the child from within. When either flap (cover flaps or screen flaps) are unfolded, the respective connectors on the flaps are attached to corresponding connectors (not shown) on the cover 70 to thereby hold each flap in its unfolded and open position.

For added foundational support, a weight or ballast 30, is configured to be removable from the play pen. It is preferred that the weight 30 be attached to the underside of the base 20. In this regard, the underside of the base 20 has a connector 31 for that purpose which corresponds to a reciprocal connector 33 on the weight 30. Any connector suited for the intended purpose may be used including, but not limited to hook-and-loop (i.e., Velcro-type), restickable adhesive or adhesive tape, magnetic strips, and the like. The weight 30 may be, but is not limited to, a covered lead strip or piece, a bean bag, a sand bag, or any other material or combination of materials suited for the intended purpose.

The side supports 44 also may be configured with loop or hook-like members 58. This provides additional foundation support, if needed, by tying a rope, chain, wire, or similar object to the loop 58 at one end and tying the other end of the rope, chain, wire, or similar object to any external ground support structure such as a spike driven into the ground, a lamp post, a bike rack, a fence, and the like.

As illustrated and described, this play pen may be inflated through a single valve 50. It also must be understood that each individual section (i.e., base 20 and side walls 40A–D) of this play pen may be separately and independently inflatable. In this configuration, each section is an independent unit with no air passages 48 between any section. Each section has its own air valve 50 and each section is individually inflatable.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. A play pen comprising:

a. a base having a bottom and at least three outer edges;

b. side walls equal in number to said at least three outer edges of said base, each of said side walls having a bottom surface, a side surface, and a top surface, with a first of such side walls connected to one outer edge of said base, and the first two remaining said side walls attached to each side surface of said first side wall and each said side wall removably attachable at their bottom surface to a corresponding outer edge of said base, leaving two side walls as distal end side walls each removably attachable to the other;

c. a removably attachable side support member adjacent to one or more corners defined by said side walls when said side walls are upstanding and attached; and d. a base support member adjacent to said bottom surface of said side walls.

2. The play pen as defined in claim 1 further comprising a first attachment means for removably attaching said bottom surfaces of all said side walls to the corresponding outer edges of said base, for removably attaching adjacent side surfaces of each of said side walls to each other, and for removably attaching said distal side walls to each other.

3. The play pen as defined in claim 1 wherein said base and said side walls are inflatable.

4. The play pen as defined in claim 3 wherein said base and said side walls are each separate individually inflatable sections.

5. The play pen as defined in claim 3 further comprising air channels between said base and said first side wall, and air channels between each adjacent side wall.

6. The play pen as defined in claim 1 further comprising retaining means in said base support member for removably receiving and retaining therein said side support members.

7. The play pen as defined in claim 1 further comprising a second attachment means for removably attaching said base supports to said side walls and for removably attaching said side supports to said side walls.

8. The play pen as defined in claim 1 further comprising a removably attachable canopy.

9. The play pen as defined in claim 8 further comprising a frame member under said canopy, said frame member further having a frame connector, frame arms having a first end distal from said frame connector and a second end removably connected to said frame connector, said first end removably connectable to said side support.

10. The play pen as defined in claim 8 further comprising one or more movable flaps on said canopy.

11. The play pen as defined in claim 10 further comprising one or more mesh members on said canopy underneath said one or more movable flaps.

12. The play pen as defined in claim 10 further comprising third attachment means for releasably maintaining said one or more movable flaps in place on said canopy, and for releasably maintaining said canopy to said side walls.

13. The play pen as defined in claim 1 further comprising an opening in one or more said side walls.

14. The play pen as defined in claim 13 wherein said opening further comprises a divider member.

15. The play pen as defined in claim 13 wherein said opening further comprises a mesh-like member therein.

16. The play pen as defined in claim 13 wherein said opening further comprises a transparent air-resistant barrier therein.

17. The play pen as defined in claim 13 further comprising a weight member removably attachable to said base bottom underside.

18. A play pen comprising:

a. a base having a bottom and at least three outer edges; and b. side walls equal in number to said at least three outer edges of said base, each of said side walls having a bottom surface, a side surface, and a top surface, with a first of such side walls connected to one outer edge of said base, and the first two remaining said side walls attached to each side surface of said first side wall and each said side wall removably attachable at their bottom surface to a corresponding outer edge of said base, leaving two side walls as distal end side walls each removably attachable to the other; and c. an opening in one or more said side walls, said opening comprising a transparent air-resistant barrier.

19. The play pen as defined in claim 18 further comprising a first attachment means for removably attaching said bottom surfaces of all said side walls to the corresponding outer edges of said base, for removably attaching adjacent side surfaces of each of said side walls to each other, and for removably attaching said distal side walls to each other.

20. The play pen as defined in claim 18 wherein said base and said side walls are inflatable.

21. The play pen as defined in claim 20 wherein said base and said side walls are each separate individually inflatable sections.

22. The play pen as defined in claim 20 further comprising air channels between said base and said first side wall, and air channels between each adjacent side wall.

23. The play pen as defined in claim 18 further comprising a removably attachable side support member adjacent to one or more corners defined by said side walls when said side walls are upstanding and attached.

24. The play pen as defined in claim 23 further comprising a base support member adjacent to said bottom surface of said side walls.

25. The play pen as defined in claim 24 further comprising retaining means in said base support member for removably receiving and retaining therein said side support members.

26. The play pen as defined in claim 24 further comprising a second attachment means for removably attaching said base supports to said side walls and for removably attaching said side supports to said side walls.

27. The play pen as defined in claim 23 further comprising a removably attachable canopy.

28. The play pen as defined in claim 27 further comprising a frame member under said canopy, said frame member further having a frame connector, frame arms having a first end distal from said frame connector and a second end removably connected to said frame connector, said first end removably connectable to said side support.

29. The play pen as defined in claim 27 further comprising one or more movable flaps on said canopy.

30. The play pen as defined in claim 29 further comprising one or more mesh members on said canopy underneath said one or more movable flaps.

31. The play pen as defined in claim 29 further comprising third attachment means for releasably maintaining said one or more movable flaps in place on said canopy, and for releasably maintaining said canopy to said side walls.

32. The play pen as defined in claim 18 wherein said opening further comprises a divider member.

33. The play pen as defined in claim 18 further comprising a weight member removably attachable to said base bottom underside.

* * * * *